US012150579B2

(12) United States Patent
Saman

(10) Patent No.: US 12,150,579 B2
(45) **Date of Patent: *Nov. 26, 2024**

(54) RAILING BRACKET HOLDER AND SYSTEMS, KITS, AND METHODS THEREOF

(71) Applicant: Sam S. Saman, Annandale, VA (US)

(72) Inventor: Sam S. Saman, Annandale, VA (US)

(73) Assignee: Sam S. Saman, Annandale, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/174,839

(22) Filed: Feb. 27, 2023

(65) Prior Publication Data

US 2023/0210278 A1 Jul. 6, 2023

Related U.S. Application Data

(60) Continuation of application No. 17/717,180, filed on Apr. 11, 2022, now Pat. No. 11,589,692, which is a division of application No. 17/376,201, filed on Jul. 15, 2021, now Pat. No. 11,317,743.

(51) Int. Cl.
*A47G 7/04* (2006.01)

(52) U.S. Cl.
CPC ..... *A47G 7/044* (2013.01)

(58) Field of Classification Search
CPC ..... A47G 7/04; A47G 7/041; A47G 7/042; A47G 7/044; A47G 7/045; F16M 13/02; F16M 13/022
USPC ..... 248/27.8, 228.3, 228.5, 229.12, 229.14, 248/229.22, 229.24, 230.3, 230.5, 231.41, 248/231.61; 47/39
See application file for complete search history.

(56) References Cited

U.S. PATENT DOCUMENTS

| | | | |
|---|---|---|---|
| 1,731,139 | A | 10/1929 | Kift |
| 2,261,326 | A | 11/1941 | Atkisson et al. |
| 2,861,764 | A | 11/1958 | Fisher |
| 3,664,626 | A | 5/1972 | Sneller |
| 3,776,549 | A | 12/1973 | Ganis |
| 4,109,415 | A | 8/1978 | Hall |
| 4,559,738 | A | 12/1985 | Helfman |
| 4,640,045 | A | 2/1987 | Nesbitt et al. |
| D299,088 | S | 12/1988 | Monza |
| D332,212 | S | 1/1993 | Mitchell et al. |
| D335,986 | S | 6/1993 | Saffell |

(Continued)

FOREIGN PATENT DOCUMENTS

DE 3134983 A1 3/1983

*Primary Examiner* — Jonathan Liu
*Assistant Examiner* — Guang H Guan
(74) *Attorney, Agent, or Firm* — XSENSUS LLP

(57) ABSTRACT

A bracket assembly adapted to be removably coupled to a railing at a first side and hold a portion of a container at a second side can comprise a lower section and an upper section removably coupled to the lower section. The upper section can be a bent strip that forms a receptacle to receive the portion of the container, and the lower section can include a body in the form of a second bent strip, and a fixed connection post extending from an upper surface of the body to interface with an opening in the connection interface of the upper section to removably couple the upper section to the lower section via the at least one fastener. The platform section can include a first step and a second step each extending from the connection interface to respective ones of the retaining arms.

20 Claims, 13 Drawing Sheets

(56) References Cited

U.S. PATENT DOCUMENTS

| | | | | |
|---|---|---|---|---|
| 5,240,214 | A | 8/1993 | Birnbaum et al. | |
| 5,269,095 | A | 12/1993 | Helfman et al. | |
| 5,368,267 | A | 11/1994 | Howard | |
| 5,687,515 | A | 11/1997 | Rodrigues et al. | |
| 5,822,918 | A | 10/1998 | Helfman et al. | |
| 6,012,690 | A | 1/2000 | Cohen | |
| 6,398,174 | B1 | 6/2002 | Emalfarb | |
| 6,425,555 | B1 | 7/2002 | Hedeman | |
| 6,557,806 | B2 | 5/2003 | Davies | |
| D568,727 | S | 5/2008 | Walker et al. | |
| 7,735,800 | B2 | 6/2010 | Lunato et al. | |
| 7,884,283 | B1 | 2/2011 | Ousley | |
| 9,107,526 | B2 | 8/2015 | Rife | |
| 9,168,783 | B2 | 10/2015 | Black et al. | |
| 9,307,700 | B1 | 4/2016 | Schmitt | |
| 10,568,445 | B1 | 2/2020 | Green | |
| 11,317,743 | B1 | 5/2022 | Saman | |
| 11,589,692 | B2 * | 2/2023 | Saman | A47G 7/044 |
| 2003/0173483 | A1 | 9/2003 | Yeh | |
| 2009/0020047 | A1 | 1/2009 | Noble et al. | |
| 2011/0036001 | A1 | 2/2011 | Aker | |
| 2013/0240697 | A1 | 9/2013 | Rutigliano | |
| 2015/0238027 | A1 | 8/2015 | Yeh | |
| 2023/0018993 | A1 * | 1/2023 | Saman | A47G 7/044 |
| 2023/0210278 | A1 * | 7/2023 | Saman | A47G 7/044 |
| | | | | 248/207 |

* cited by examiner

RAILING BRACKET HOLDER AND SYSTEMS, KITS, AND METHODS THEREOF

CROSS-REFERENCE TO RELATED APPLICATIONS

This application is a continuation of U.S. application Ser. No. 17/717,180, filed Apr. 11, 2022 (now U.S. Pat. No. 11,589,692), which is a divisional of U.S. application Ser. No. 17/376,201 filed Jul. 15, 2021 (now U.S. Pat. No. 11,317,743), the contents and disclosure of each are hereby incorporated by reference in their entirety.

FIELD

The present disclosure involves one or more brackets that can be removably coupled to a railing to hold a container above the railing, and systems, assemblies, kits, and methods thereof.

SUMMARY

According to an aspect of one or more embodiments of the present disclosure, a bracket adapted to be removably coupled to a rail is described or provided. The bracket can comprise a lower section to be provided adjacent to at least opposing sides of the rail in a case where the bracket is removably coupled to the rail; an upper section to be provided adjacent to a top surface of the rail in the case where the bracket is removably coupled to the rail; and at least one fastener to removably couple the upper section to the lower section with the rail entirely below the upper section. The upper section can be a bent strip of metal that forms a receptacle to receive and retain a planter box, where the upper section can include a connection interface to removably couple the upper section to the lower section using the at least one fastener, a platform section, on which to place the planter box, having a first platform and a second platform opposite the first platform, and a pair of opposing retaining arms respectively extending from the first platform and the second platform of the platform section. The lower section can include a body made of metal having at least one welded screw extending from an upper surface of the body to interface with a respective at least one opening in the connection interface of the upper section and removably couple the upper section to the lower section. The platform section can include a first step and a second step opposite the first step that extend from opposite ends of the connection interface to the respective ones of the retaining arms and respectively contain the first platform and the second platform.

According to another aspect of one or more embodiments of the present disclosure, a kit for holding a planter box on railing can be provided or implemented. The kit can comprise a first bracket assembly; and a second bracket assembly. Each of the first bracket assembly and the second bracket assembly can include: a lower section to be fitted adjacent to at least opposing sides of the railing; an upper section to be fitted adjacent a top surface of the railing; and at least one fastener to removably couple the upper section to the lower section and thus the first bracket assembly or the second bracket assembly to the railing such that the railing is entirely below the upper section. The upper section can be a first strip of material, the first strip being bent so as to form a receptacle to receive the planter box, the upper section including a connection interface to removably couple the upper section to the lower section using the at least one fastener, a platform section on which to place the planter box, and a pair of retaining arms extending from opposite portions of the platform section. The lower section can be a second strip of material, the second strip having a width that is the same as the first strip forming the upper section, and a fixed connection post extending from an upper surface of the second strip to extend through an opening in the connection interface of the upper section and interface with the at least one fastener to removably couple the upper section to the lower section. The platform section of the upper section can include a first step and a second step each extending from the connection interface to respective ones of the retaining arms.

According to yet another aspect of one or more embodiments of the present disclosure, a method regarding a bracket assembly can be implemented. The method can comprise providing a lower section of a bracket assembly; and providing an upper section of the bracket assembly, the upper section being removably coupleable to the lower section. The upper section can be a first bent strip that forms a receptacle to receive a portion of a container, the upper section including a connection interface to removably couple the upper section to the lower section using at least one fastener, a platform section on which to place the portion of the container, and a pair of retaining arms extending from opposite sides of the platform section. The lower section can includes a body in the form of a second bent strip, and a fixed connection post extending from an upper surface of the body to interface with an opening in the connection interface of the upper section to removably couple the upper section to the lower section via the at least one fastener. The platform section can include a first step and a second step each extending from the connection interface to respective ones of the retaining arms.

And according to one or more embodiments, a method regarding a bracket assembly is described or implemented. The method can comprise: providing a lower section of a bracket assembly; and providing an upper section of the bracket assembly, the upper section being removably coupleable to the lower section, wherein the upper section forms a receptacle to receive a portion of a container, the upper section including a connection interface to removably couple the upper section to the lower section using at least one fastener, a platform section, and a pair of retaining arms extending from the platform section, wherein the lower section includes a body in the form of a second bent strip, the lower section having an interface section to interface with the connection interface of the upper section to removably couple the upper section to the lower section via the at least one fastener, and wherein the platform section includes a step portion extending toward the pair of retaining arms.

Also, according to one or more embodiments, a method regarding a bracket assembly is described or implemented. The method can comprise: providing a lower section of a bracket assembly; and providing an upper section of the bracket assembly, the upper section being fixedly coupled to the lower section. The upper section can form a receptacle to receive a portion of a container, the upper section can include a platform section and a pair of retaining arms extending from the platform section, the lower section includes a body in the form of a second bent strip, the lower section having an interface section to interface with the connection interface of the upper section to fixedly couple the upper section to the lower section, the platform section can include a step portion extending toward the pair of retaining arms, the upper section can extend in a first direction and a second direction, and/or the lower section can extend in a third direction opposite the second direction and perpendicular to the first direction.

According to one or more embodiments, a bracket adapted to be removably coupled to a rail can be provided or implemented. The bracket can comprise a lower section to be provided adjacent to at least opposing sides of the rail in a case where the bracket is removably coupled to the rail; an upper section to be provided above a top surface of the rail in the case where the bracket is removably coupled to the rail; and at least one fastener to removably couple the bracket to the rail with the rail entirely below the upper section. The upper section can be made of at least one bent strip of metal and can form a receptacle to receive and retain a planter box. The upper section can include: a pair of platform sections on which to place the planter box, including a first platform section and a second platform section, and a pair of retaining arms, including a first retaining arm extending from the first platform section and a second retaining arm extending from the second platform section. The lower section can include an interface section, and at least one welded screw extending from the interface section to interface with at least one opening in a connection interface and removably couple the interface section to the connection interface. The first platform section can include a first step and the second platform section can include a second step, the first and second platform sections can respectively extend from opposite ends of the connection interface to the first retaining arm and the second retaining arm, a width of the lower section can be adjustable based on movement of interface section, and the width of the lower section can be settable using the at least one fastener removably coupled to the at least one welded screw.

According to one or more embodiments, a kit for holding a planter box on a railing can be provided or implemented. The kit can comprise a first bracket assembly; and a second bracket assembly. Each of the first bracket assembly and the second bracket assembly can include: a lower section to be fitted adjacent to at least opposing sides of the railing; an upper section to be fitted entirely above a top surface of the railing; and a plurality of fasteners. The upper section can include a plurality of strips bent to form a receptacle to receive the planter box. The upper section can include: an upper surface of a connection interface, a pair of platform sections on which to place the planter box, including a first platform section and a second platform section spaced apart from the first platform section, and a pair of retaining arms, including a first retaining arm extending from the first platform section and a second retaining arm extending from the second platform section. The lower section can include: a lower surface of the connection interface, an interface strip slidably provided adjacent to the lower surface of the connection interface, a plurality of connection posts extending from an upper surface of the interface strip to extend through a slot in the connection interface and respectively connect the plurality of fasteners. The first platform section of the upper section can include a first step and the second platform section of the upper section can include a second step, the first and second platform sections can respectively extend from the connection interface to the first retaining arm and the second retaining arm, a width of the lower section can be adjustable based on movement of interface strip, and the width of the lower section can be settable using the plurality of fasteners respectively removably coupled to the plurality of connection posts.

According to one or more embodiments, a system can be provided or implemented. The system can comprise a bracket adapted to be removably coupled to a rail, where the bracket can include: a lower section to be provided adjacent to at least opposing sides of the rail when the bracket is removably coupled to the rail; and an upper section to be provided above a top surface of the rail when the bracket is removably coupled to the rail. The upper section can form a receptacle to receive and removably retain a box having an open upper end. The upper section can include: an upper surface of a connection interface, a pair of platform sections on which to removably place a bottom surface of the box, including a first platform section and a second platform section, and a pair of retaining arms, including a first retaining arm extending from the first platform section and a second retaining arm extending from the second platform section. The lower section can include: a lower surface of the connection interface opposite the upper surface, an interface section, and a plurality of connection screws extending from an upper surface of the interface section to respectively interface with a plurality of fasteners. The first platform section can include a first step and the second platform section includes a second step, the first and second steps can respectively extend from opposite ends of the connection interface to the first retaining arm and the second retaining arm, a first height of the upper section can be greater than a second height of the lower section, the first and second retaining arms can be outward of the connection interface, and a width of the lower section can be adjustable based on movement of interface section.

Other features and aspects of this disclosure will be apparent from the following description and the accompanying drawings.

DETAILED DESCRIPTION

Figure 1:
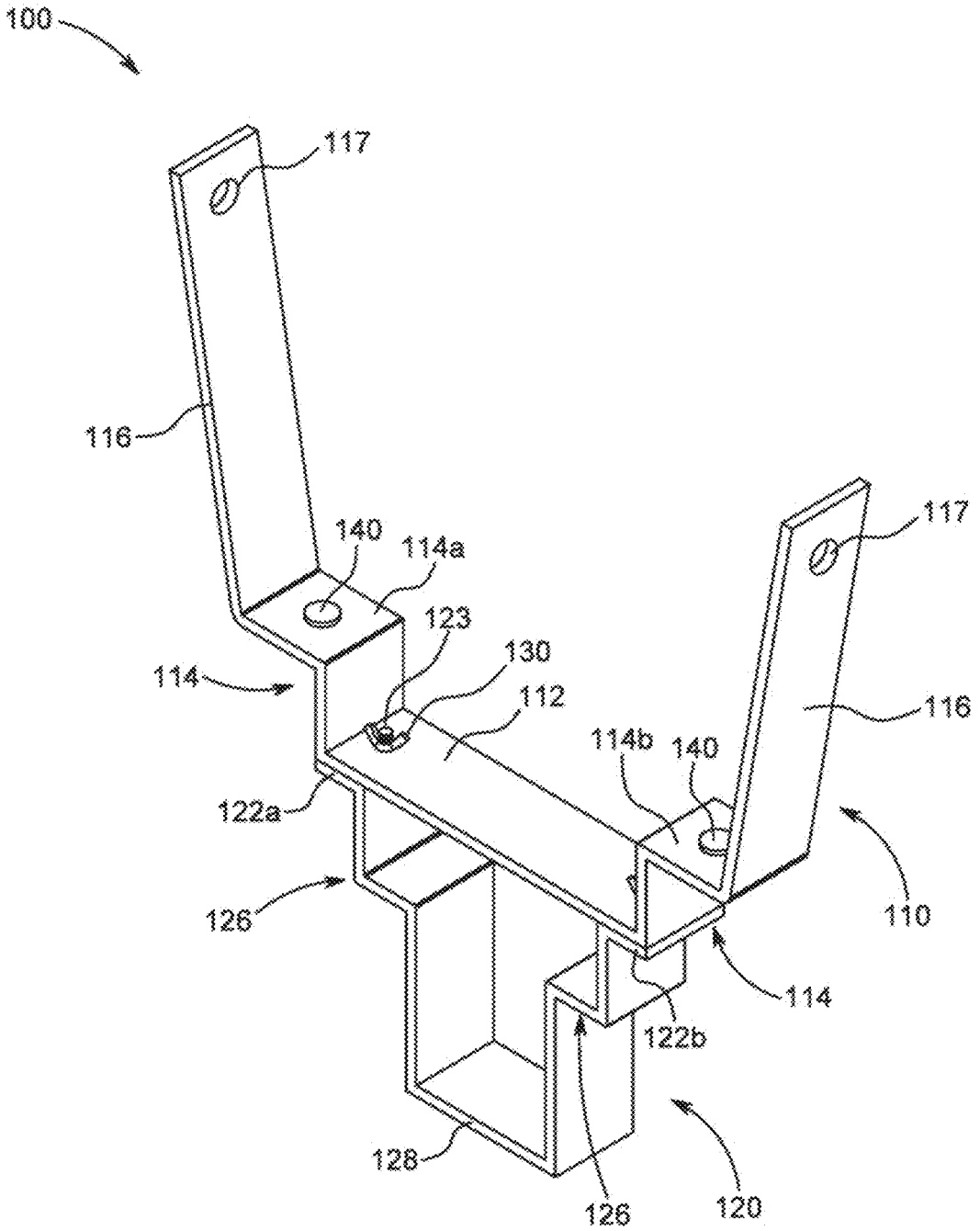
FIG. 1 is a perspective view of a bracket assembly according to one or more embodiments of the disclosed subject matter.
Figure 2:
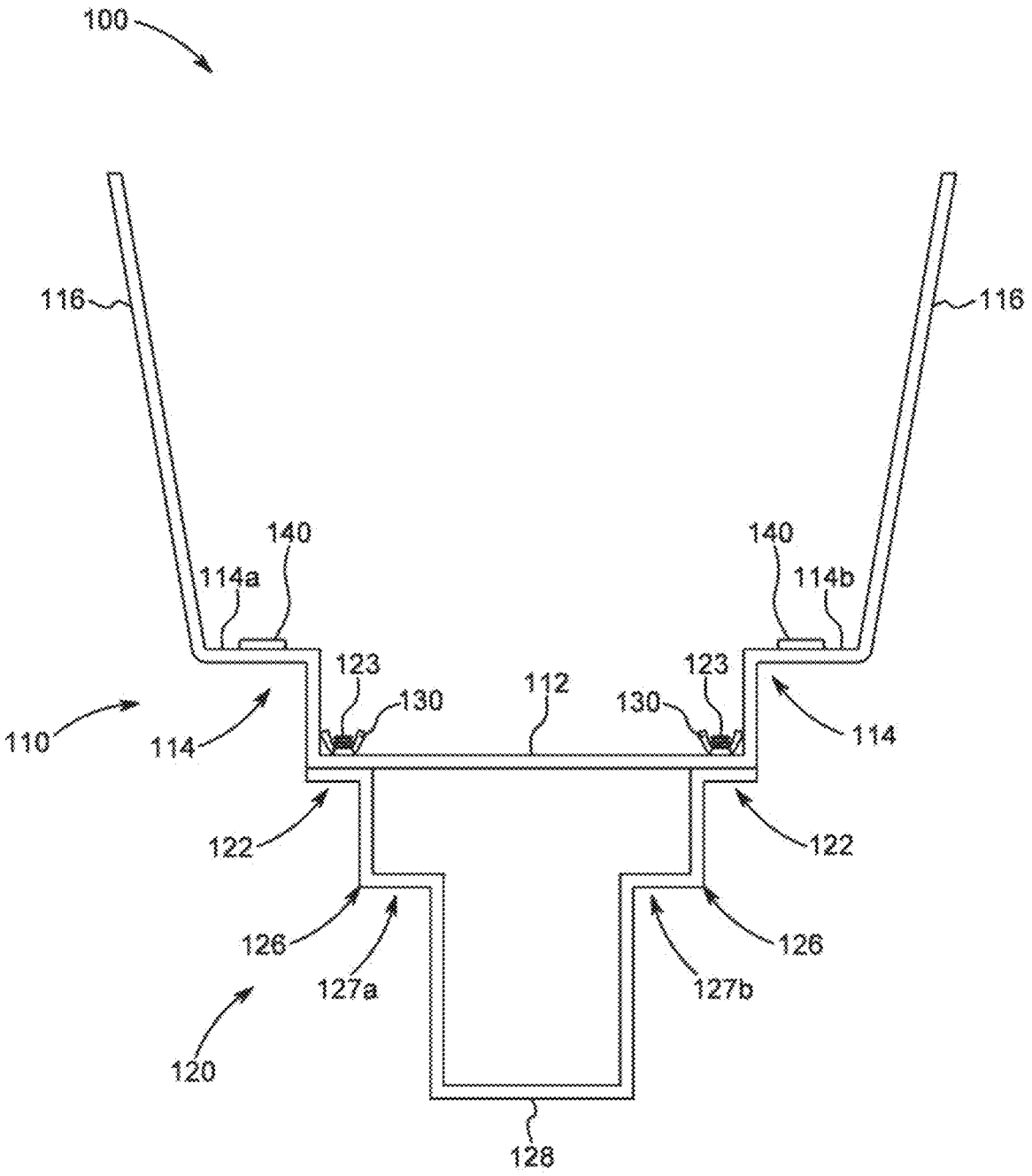
FIG. 2 is a front elevational view of the bracket assembly of FIG. 1.
Figure 3:
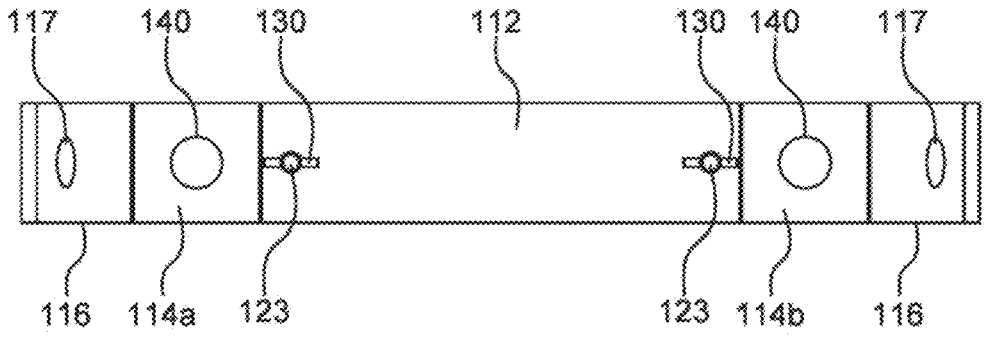
FIG. 3 is a top plan view of the bracket assembly of FIG. 1.
Figure 4:
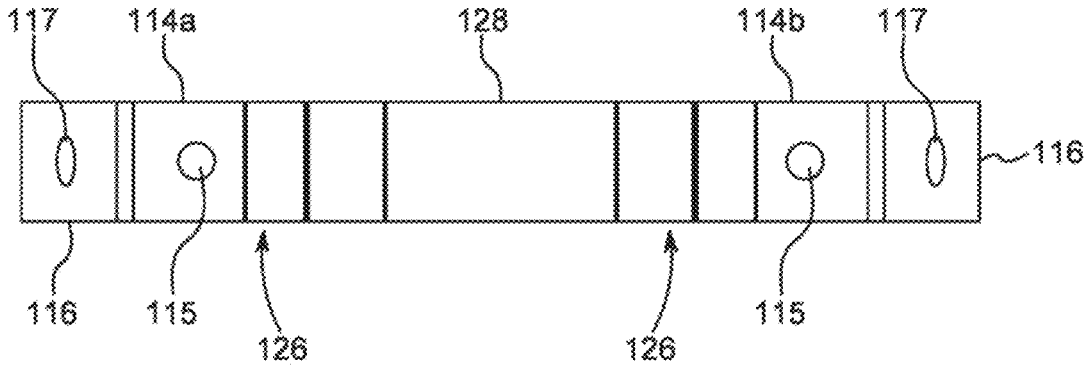
FIG. 4 is a bottom plan view of the bracket assembly of FIG. 1.

Embodiments of the disclosed subject matter involve one or more brackets that can be removably coupled to a rail to hold a container above the rail, and systems, assemblies, kits, and methods thereof. Removably coupled, as used herein, can be interpreted as the bracket not being fixedly coupled to the rail, for instance, without a screw or a bolt being directly coupled to the rail to fix the bracket to the rail. In this regard, one or more fasteners according to embodiments of the disclosed subject matter may be fastened to retain the bracket on the rail without any of the one or more fasteners also being directly fastened to the rail. Thus, removal of the bracket from the rail may show no sign in the rail (e.g., no screw or bolt holes) of the bracket having been removably coupled to the rail.

As used herein, "a" and "an" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

Turning to the figures, FIGS. 1-6 show various views of a bracket 100, which may be referred to herein as a bracket assembly 100, according to one or more embodiments of the disclosed subject matter. Discussed in more detail below with respect to FIG. 5 and FIG. 6, the bracket 100 can be removably coupled to a rail or railing 75. Additionally, also discussed in more detail below, the bracket 100 can define a receptacle to receive at least a portion of a container 50, such as a portion of a planter box.

The bracket 100 can be comprised of an upper section 110, a lower section 120, and at least one fastener 130. According to one or more embodiments, the bracket 100 can include two fasteners 130, for instance. Generally, the upper section 110 can be removably coupled to the lower section 120 using the fastener(s) 130.

The upper section 110 can have a body that includes a connection interface 112, a platform section 114, and a pair of retaining arms 116. Optionally, the body of the upper section 110 can be formed in one-piece, for instance, as hot rolled steel. According to one or more embodiments, the body can be in the form of a bent strip made of a relatively rigid material such as metal or plastic. According to one or more embodiments, a thickness and/or a width of the body of the upper section 110 can be uniform along an entire length of the upper section 110. For instance, the body may be ⅛ inch thick and one inch wide (e.g., with the exception of openings/apertures discussed below).

The connection interface 112 can form a bottom-most portion of the upper section 110. Generally, the connection interface 112 can be removably coupled to the lower section 120 (via fastener(s) 130). For instance, the connection interface 112 can have a plurality of openings or apertures 113 to receive respective connection posts 123 of the lower section 120 (see, e.g., FIG. 5). According to one or more embodiments, the openings 113 may be ¼ inch holes through the body. As an example, a center-to-center distance between the openings 113 can be 4.5 inches. As an example, an end-to-end distance of the connection interface 112 can be 6.0 inches.

The platform section 114, which may be referred to as a seat or seat section, can extend from the connection interface 112. In particular, the platform section 114 can extend from opposite ends of the connection interface 112. Hence, the platform section 114 may have or define a first platform **114*a* and a second platform 114*b* opposite the first platform 114*a*, which may be referred to herein as a first platform section and a second platform section, respectively. In this regard, the first platform 114*a* and the second platform 114*b* may extend upward and optionally outward relative to the ends of the connection interface 112. Thus, the first platform 114*a* and the second platform 114*b* may include or be in the form of a step, a first step and a second step, respectively. According to one or more embodiments, the first platform 114*a* and the second platform 114*b* can extend from opposite ends of the connection interface 112 at right angles. Hence, the first step and the second step can be right-angled steps. Optionally, the first platform 114*a* and the second platform 114*b* may be or extend parallel to the connection interface 112. As an example, the length of each of the first platform 114*a* and the second platform 114*b***, particularly the upper surfaces thereof or tops of the steps, can be ½ inch long.

The heights of the first platform **114*a* and the second platform 114*b* can be set to be at least greater than the height of the fastener(s) 130 and the connection posts 123 when the fastener(s) 130 is/are properly fixed to corresponding connection posts 123 to removably couple the upper section 110 to the lower section 120 (e.g., fastener(s) 130 below the top(s) of the connection posts 123). Thus, neither the fastener(s) 130 nor the tops of the connection posts 123 may extend to the height of the first platform 114*a* and the second platform 114*b* when the fastener(s) 130 is/are properly fixed to corresponding connection posts 123 to removably couple the upper section 110 to the lower section 120. This can prevent the fastener(s) 130 and the connection posts 123 from interfering with the container 50 when the container 50 is seated on the platform section 114. As an example, the heights of the first platform 114*a* and the second platform 114*b*** can be ¾ inch.

According to one or more embodiments, each of the first platform **114*a* and the second platform 114*b* can have one or more openings or apertures 115. A bumper 140, which can be made of rubber or plastic, can be provided in each opening 115 such that a portion of the bumper 140 extends above respective upper surfaces of the first platform 114*a* and the second platform 114*b*. Alternatively, the first platform 114*a* and the second platform 114*b* may be without any openings 115, though one or more bumpers 140 may be provided on each of the first platform 114*a* and the second platform 114*b*. Alternatively, the bumper 140 may not be provided on either the first platform 114*a* or the second platform 114*b***.

One of the retaining arms 116 may extend from each of the first platform **114*a* and the second platform 114*b*. Thus, the retaining arms 116 may be referred to herein as opposing retaining arms 116. In that the retaining arms 116 can extend from the first platform 114*a* and the second platform 114*b*, the retaining arms 116 may be entirely outward of the connection interface 112. In this regard, the retaining arms 116 may extend from the first platform 114*a* and the second platform 114*b* at an angle. The angle at which the retaining arms 116 extend, according to one or more embodiments, may be ninety degrees or an obtuse angle (e.g., 95-110 degrees) relative to the first platform 114*a* and the second platform 114***b*, respectively. Thus, a distance between the two retaining arms 116 at a bottom of the retaining arms 116 can be less than a distance between the two retaining arms 116 at a top of the retaining arms 116.

The amount by which each of the retaining arms 116 extends from the platform section 114 can be greater than a height of the bottom of the bracket 100 at the connection interface 112 to the upper surface of the platform section 114. For instance, the amount by which each of the retaining arms 116 extends from the platform section 114 can be three times or more the height of the bottom of the bracket 100 at the connection interface 112 to the upper surface of the platform section 114. As an example, the amount by which each of the retaining arms 116 extends from the platform section 114 can be 4.0 inches or more. Alternatively, the length of the retaining arms 116 in the height direction can be 4.0 inches or more. Alternatively, the length of the retaining arms 116 or the amount by which each of the retaining arms 116 extends from the platform section 114 may be less than as shown in FIGS. 1-6. For instance, the arms 116 may have a length or otherwise extend from the platform section 114 at or about at a same amount as the height of the step of the first platform 114*a* and the second platform 114*b* (e.g., ¾ inch).

According to one or more embodiments, each of the retaining arms 116 can have one or more openings or apertures 117. For instance, an upper portion of each retaining arm 116 can have the aperture 117. As an example, each opening 117 can be a ¼ inch hole, for instance, a threaded hole. Each opening 117 may be a predetermined distance from respective top edges of the retaining arms 116, for instance, ⅜ inch from the top edges.

Each aperture 117 can receive a respective bumper or a retainer (e.g., a string, a chain, threaded screw, etc.) to extend from the opposing retaining arms 116 either over the container 50 provided in the upper section 110 or toward or to a corresponding sidewall of the container 50 provided in the upper section 110. Thus, optionally, each aperture 117 can be threaded to receive a threaded bumper or screw to extend inward from the retaining arm 116 to contact opposite sides of the container 50 for lateral stability of the container 50 when provided in the bracket 100.

The lower section 120 can have a body that includes an interface section 122 and a rail support section 126. Generally, the lower section 120 can be of a fixed width (in the x-direction shown in FIG. 5 and FIG. 6, for instance). Optionally, the body of the lower section 120 can be formed in one-piece, for instance, as hot rolled steel. According to one or more embodiments, the body can be in the form of a bent strip made of a relatively rigid material such as metal. A thickness and/or a width of the body of the lower section 120 can be uniform along an entire length of the lower section 120. For instance, the body may be ⅛ inch thick and one inch wide (e.g., with the exception of the connection posts 123 discussed below). A height of the lower section 120 can be less than a height of the upper section 110, according to embodiments of the disclosed subject matter.

The interface section 122, which can include opposing first interface portion 122*a* and second interface portion 122*b*, can have a fixed width (in the x-direction shown in FIG. 5 and FIG. 6, for instance), wherein the fixed width thereof may correspond to or substantially correspond to the fixed width of the connection interface 112 of the upper section 110. A connection post 123 can extend from respective upper surfaces of the first interface portion 122*a* and second interface portion 122*b*. Optionally, the connection posts 123 can be fixedly connected (e.g., welded or formed in one piece via machining or molding, for instance) to the respective upper surfaces of the first interface portion 122*a* and second interface portion 122*b*. Hence, the connection posts 123 may be referred to or characterized as fixed or welded connection posts. In this regard, the fixed nature of the connection posts 123 may also be by way of the fixed width of the interface section 122. According to one or more embodiments, the connection posts 123 may be threaded. Hence, the connection posts 123, according to one or more embodiments, may be referred to or characterized as a threaded post, screws, or fixed screws. Here, the interface section 122 can include only two connection posts 123. As but one example, a distance from one connection post 123 to the other connection post 123 can be 5.0 inches, though embodiments of the disclosed subject matter are not so limited. A height of the connection posts 123, as an example, can be ⅜ inch.

The rail support section 126 can include a pair of opposing stepped portions, a first stepped portion 127*a* and a second stepped portion 127*b*, and a base 128. The first stepped portion 127*a* and the second stepped portion 127*b* can respectively extend downward from the first interface portion 122*a* and the second interface portion 122*b*, for instance, at ninety degrees, and then inward toward each other, for instance, at ninety degrees, followed by downward, for instance, at ninety degrees to the base 128.

In this example, the height of the first stepped portion 127*a* and the second stepped portion 127*b* between the interface section 122 can be less than the height of the first stepped portion 127*a* and the second stepped portion 127*b* between the base 128. According to one or more embodiments, at least the height of the first stepped portion 127*a* and the second stepped portion 127*b* to the interface section 122, as well as a distance between the upper walls of the first stepped portion 127*a* and the second stepped portion 127*b*, can be set or defined based on the geometry (e.g., height/thickness and/or width) of a railing to which the rail support section 126 is to be fitted around. For instance, the sizing of the rail support section 126 can be to fit rail sizes 1×4, 1×6, 2×4, or 2×6 (in inches).

Optionally, the base 128, which may define a bottom wall of the lower section 120 (and the bracket 100), can also be sized based on the geometry (e.g., height, width, etc.) of the railing to which the rail support section 126 is to be fitted around. As examples, the width of the base 128 can be 2 1/16 inches, the height of the bottom portion of the first stepped portion 127*a* and the second stepped portion 127*b* can be 2 10/32 inches, the base of the first stepped portion 127*a* and the second stepped portion 127*b* can be ¾ inches, and/or the height of the upper portion of the first stepped portion 127*a* and the second stepped portion 127*b* can be 1 1/16 inches.

The fasteners 130 can removably couple the upper section 110 to the lower section 120. In particular, the fasteners 130 can be fastened to respective connection posts 123 with the connection posts 123 extending through respective openings 113 of the connection interface 112 of the upper section 110. The fasteners 130, as an example, may be nuts with or without a washer (e.g., wing nuts) and may be threaded onto threaded ends of the connection posts 123 to removably couple the upper section 110 to the lower section 120. The connection posts 123 may be considered part of the fasteners 130 according to one or more embodiments of the disclosed subject matter.

Figure 5:
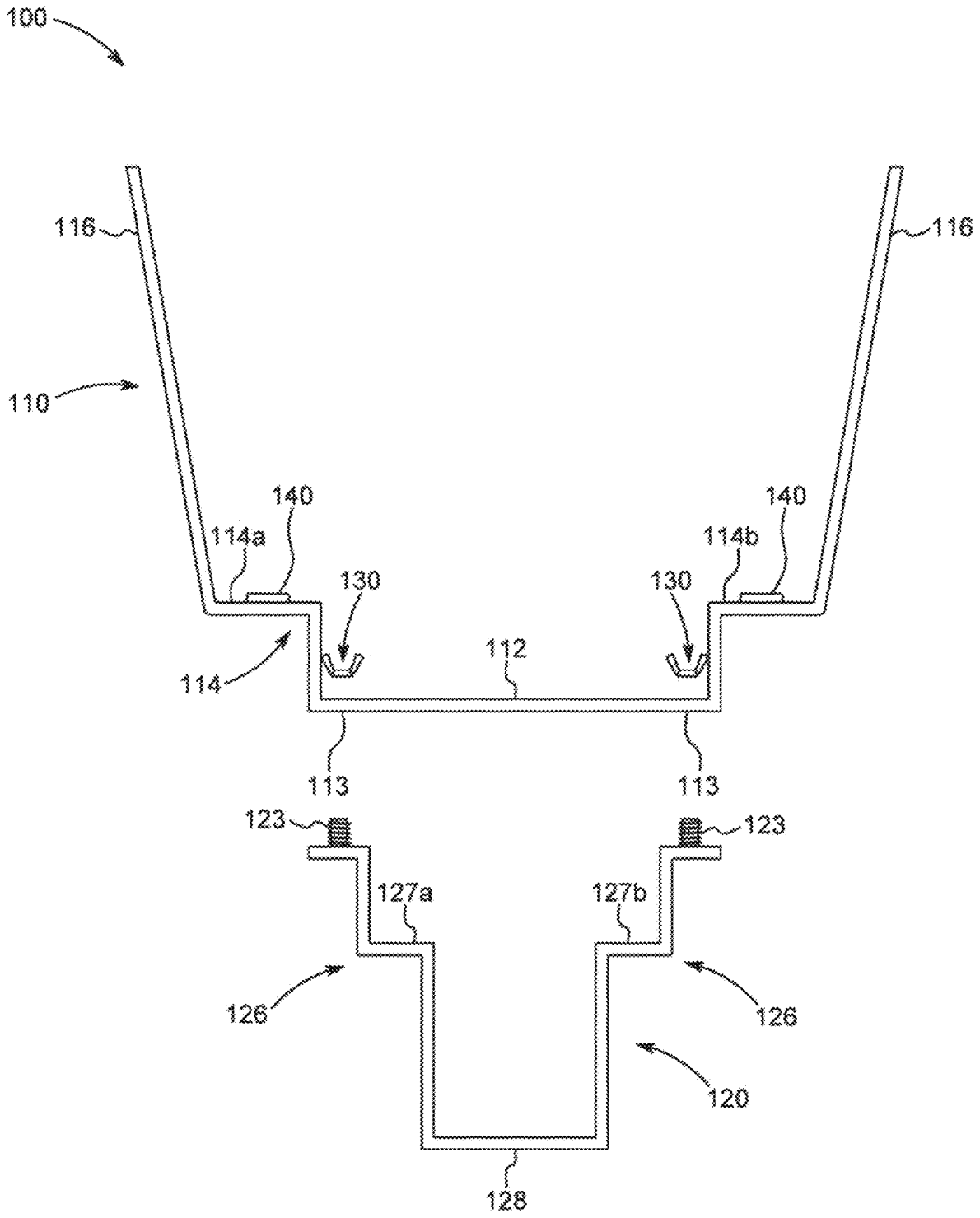
FIG. 5 is an exploded view of the bracket assembly of FIG. 1.
Figure 6:
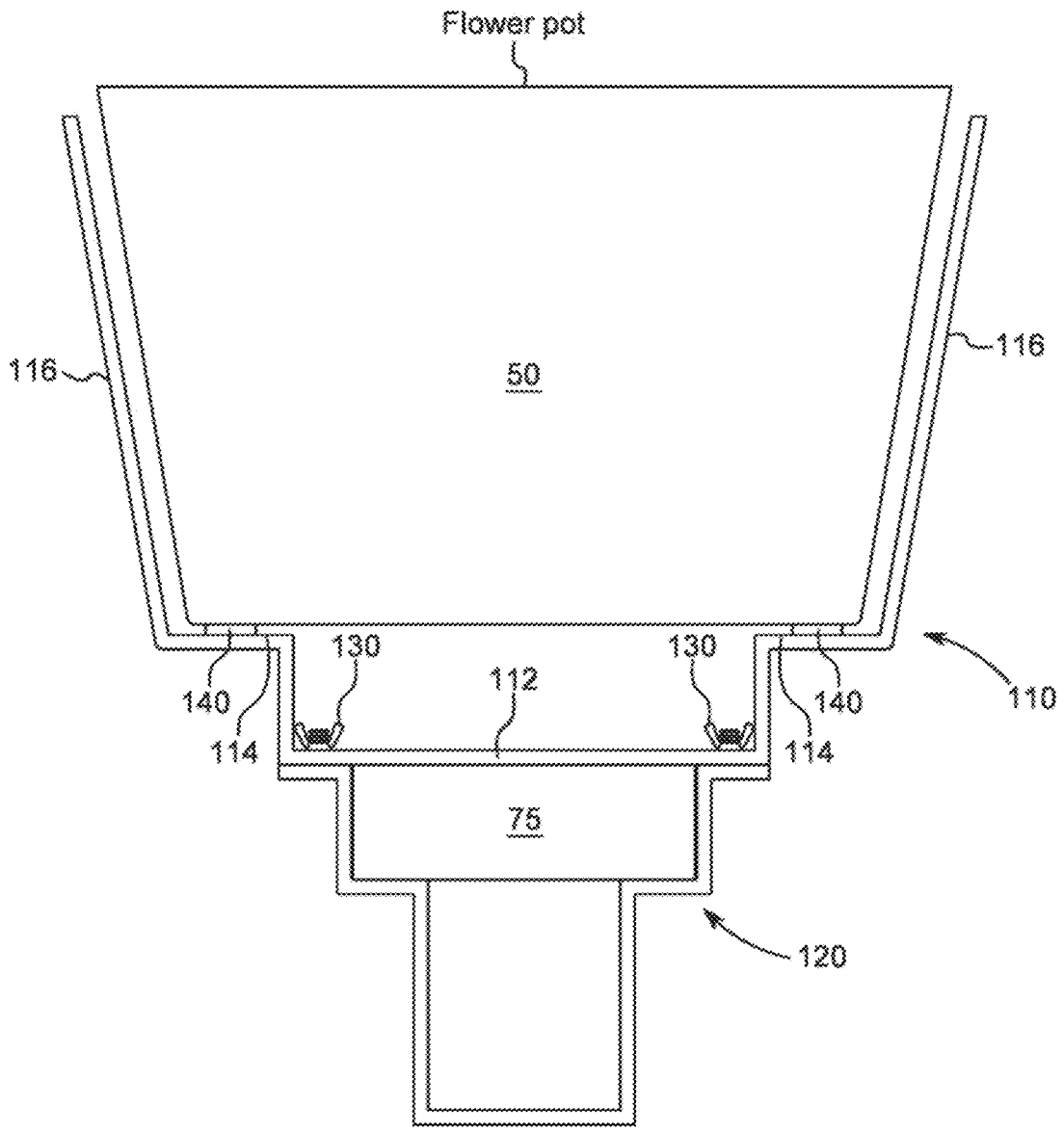
FIG. 6 is an exemplary use view of the bracket assembly of FIG. 1 removably coupled to a rail.
Figure 7:
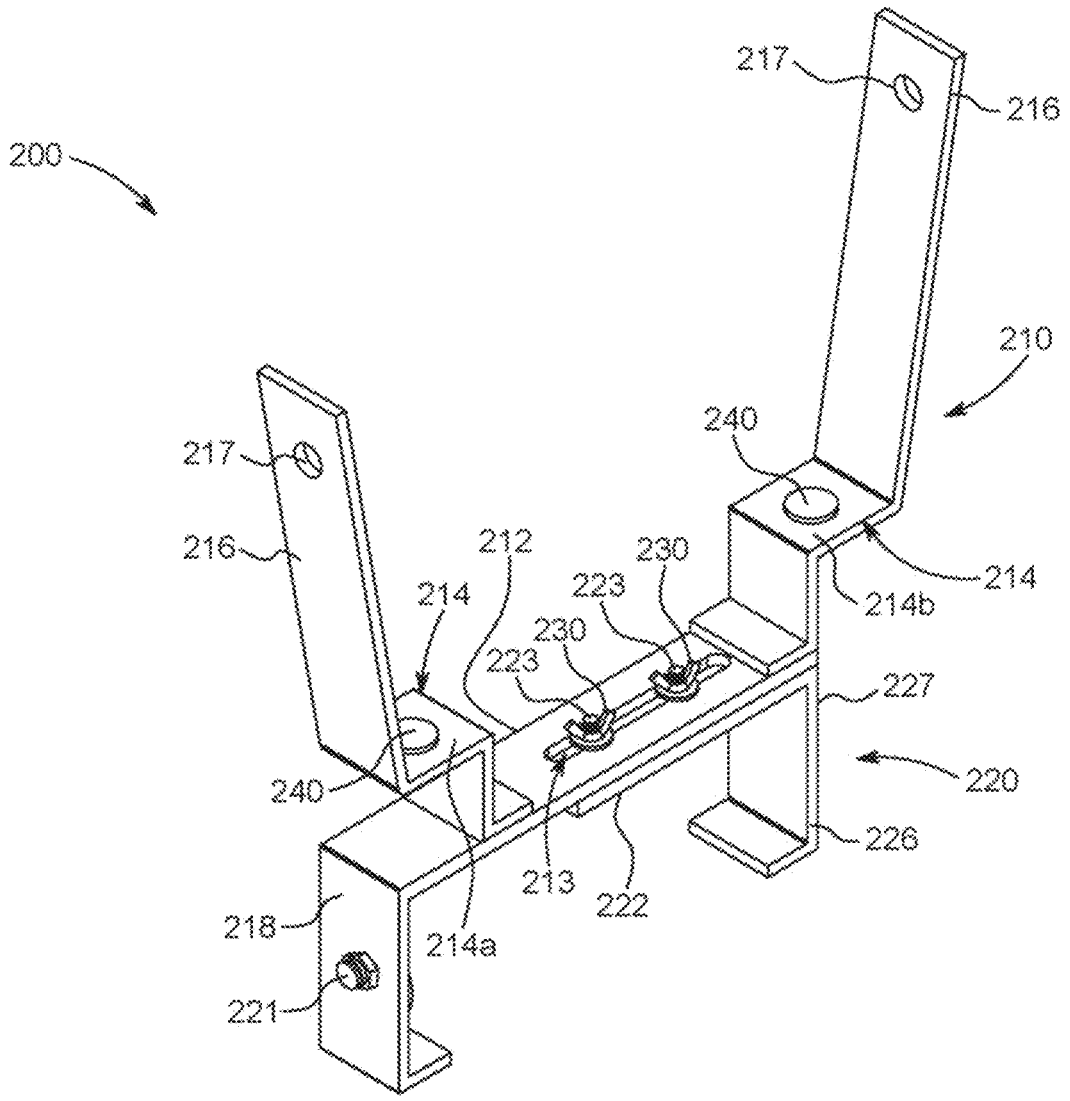
FIG. 7 is a top perspective view of another bracket assembly according to one or more embodiments of the disclosed subject matter.
Figure 8:
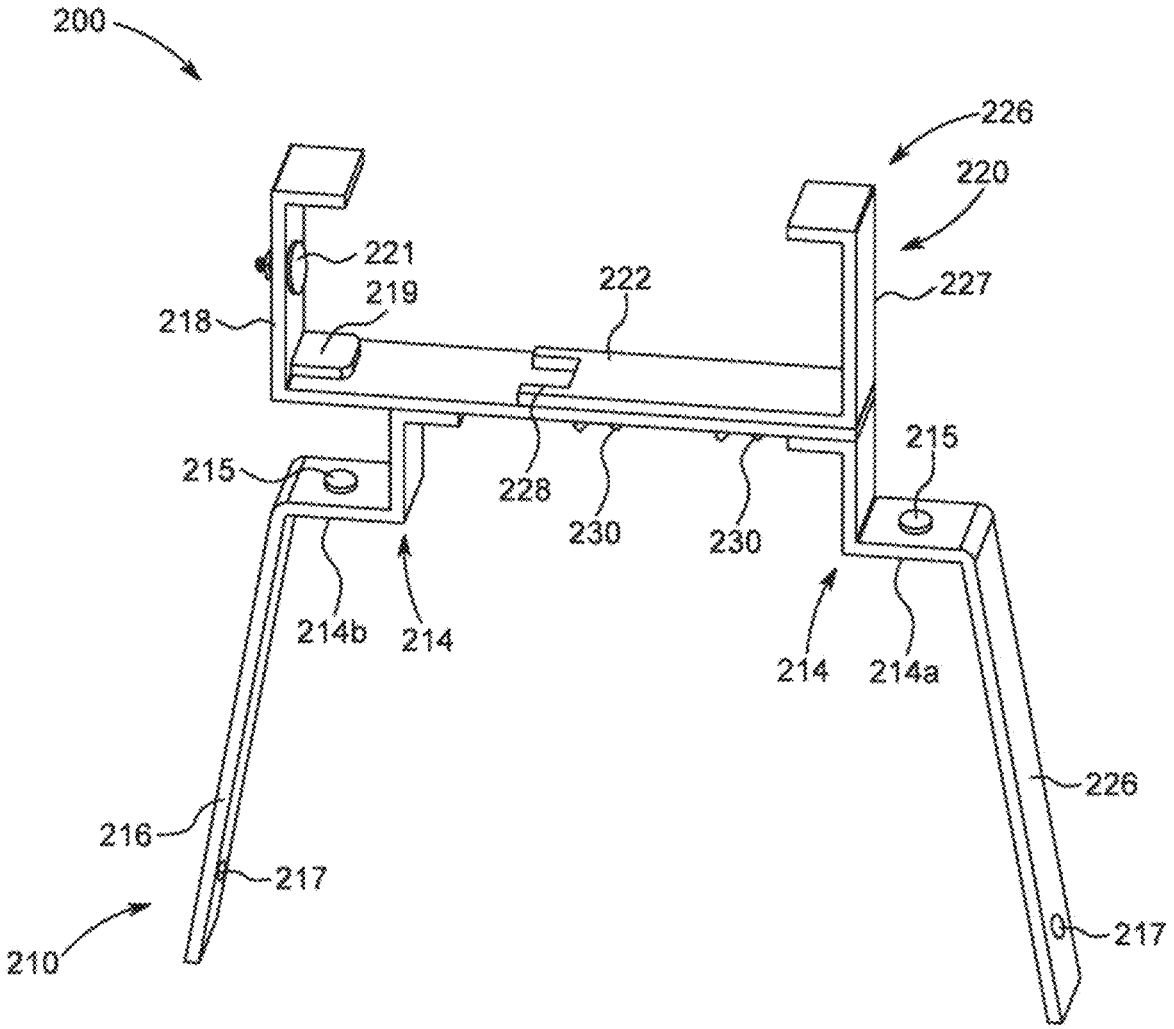
FIG. 8 is a bottom perspective view of the bracket assembly of FIG. 7.
Figure 9:
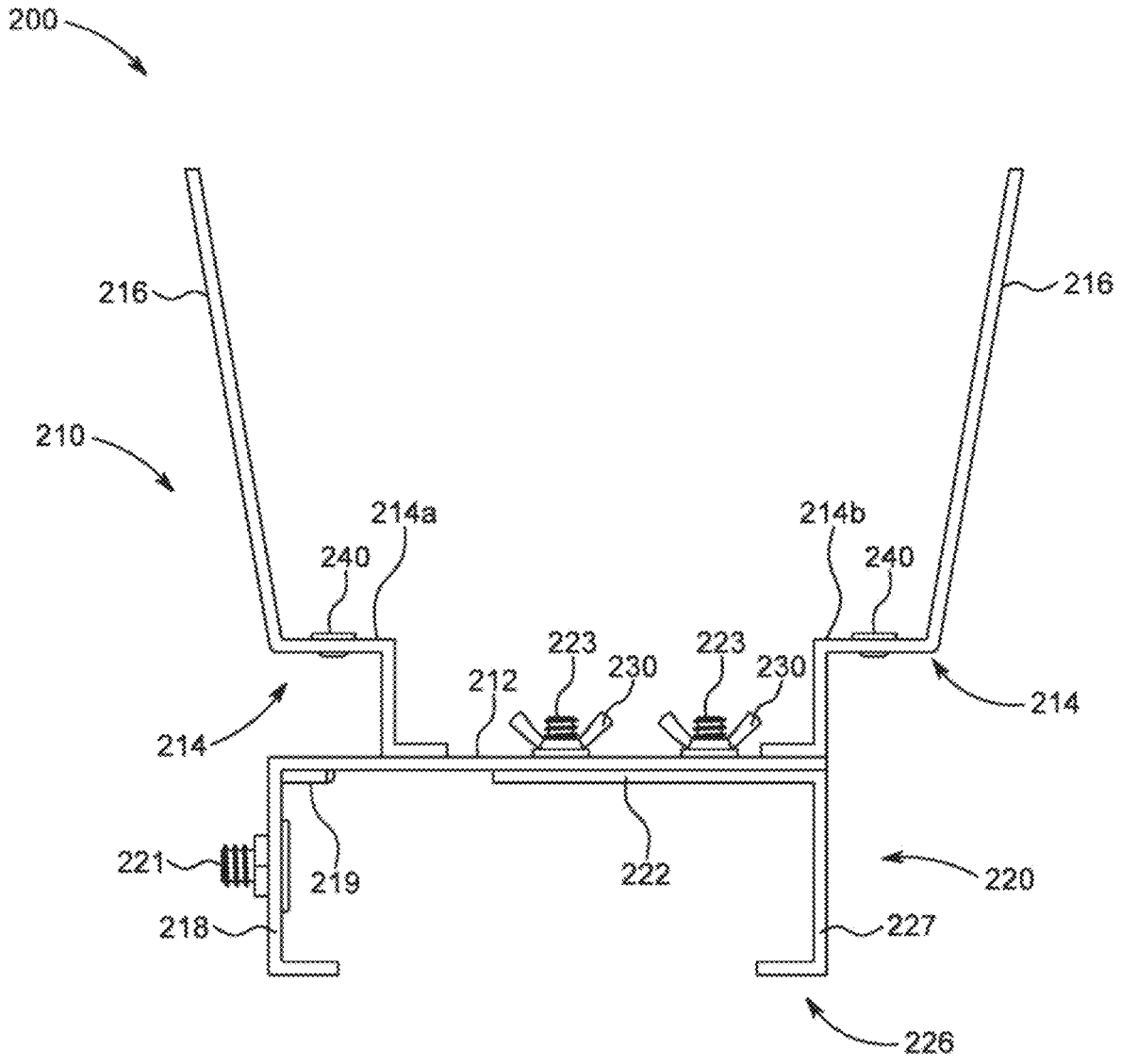
FIG. 9 is a front elevational view of the bracket assembly of FIG. 7.
Figure 10:
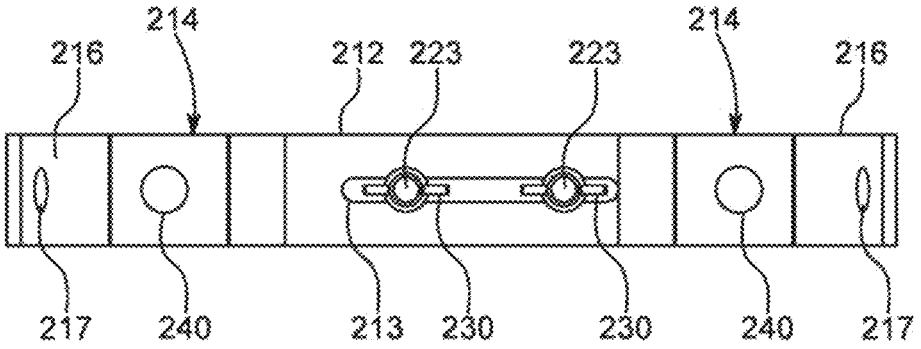
FIG. 10 is a top plan view of the bracket assembly of FIG. 7.
Figure 11:
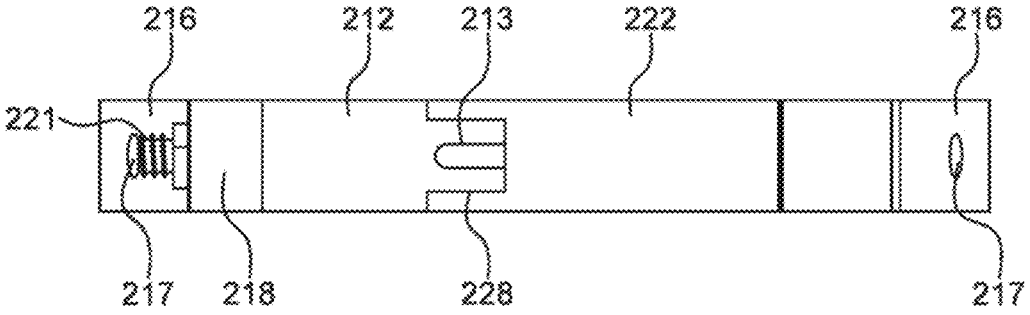
FIG. 11 is a bottom plan view of the bracket assembly of FIG. 7.

Turning now to FIG. 5 and FIG. 6, as shown, the upper section 110 can be removably coupled to the lower section 120 via the fasteners 130 fastening to the respective connection posts 123. Here, as noted above, the fasteners 130 can be fastened to respective connection posts 123 with the connection posts 123 extending through respective openings 113 of the connection interface 112 of the upper section 110.

As shown in FIG. 6, the upper section 110 can be removably coupled to the lower section 120 such that the bracket 100 can be removably coupled to a rail or railing 75 by the upper section 110 connected to the lower section 120. More specifically, the upper section 110 and the lower section 120, when removably coupled to each other (and the railing 75), can completely surround the railing 75, such as shown in the end view of FIG. 6. The connection may also be characterized as sandwiching the railing 75. In this regard, the upper section 110 may be entirely above the railing 75 when the bracket 100 is removably coupled to the railing 75. Here, the connection interface 112 can be arranged adjacent to an upper or top surface of the railing 75 when the bracket 100 is removably coupled to the railing 75. According to one or more embodiments, the lower section 120 can be arranged or fitted adjacent to at least opposing sides of the railing 75. In some cases, one or more spacers or shims may be provided between one or more portions of the bracket 100 and the railing 75 to ensure a more tight fit.

The upper section 110 can form a receptacle to receive at least a portion of the container 50, which may be a planter box or the like. In particular, as shown in FIG. 6, for instance, the body of the upper section 110 can be bent so as to form a receptacle to receive the container 50. In some respects, the upper section 110 can also retain the portion of the container 50 in the receptacle. A bottom of the container 50 can be provided on the platform section 114. That is, opposite sides of the bottom of the container 50 can rest on the first platform 114*a* and the second platform 114*b*, respectively. Optionally, as noted above, the bottom of the container 50 can rest on bumpers 140 provided at least on the upper surfaces of the first platform 114*a* and the second platform 114*b*. Opposing sides of the container 50 can be provided between the opposing retaining arms 116. When provided between the retaining arms 116, the sides of the container 50 may abut or be adjacent to the retaining arms 116. Thus, a minimum width between the retaining arms 116 can be greater than a maximum width of the container 50.

The bracket 100 may be part of a kit to retain and hold the container 50 above the railing 75, such as shown in FIG. 6. For instance, the kit may contain or consist of at least two brackets 100 (with or without fasteners 130). Thus, a portion of the container 50 (e.g., first end portion) can extend through the receptacle formed by one of the brackets 100 and another portion of the container 50 (e.g., second end portion) can extend through the receptacle formed by another of the brackets 100.

Turning now to FIGS. 7-13, these figures show various views of another bracket 200, which may be referred to herein as a bracket assembly 200, according to one or more embodiments of the disclosed subject matter. Discussed in more detail below with respect to FIG. 12 and FIG. 13, the bracket 200 can be removably coupled to a rail or railing 75. Additionally, also discussed in more detail below, the bracket 200 can define a receptacle to receive at least a portion of a container 50, such as a portion of a planter box.

The bracket 200 can be comprised of an upper section 210, a lower section 220, and at least one fastener 230. The bracket 200 can include only one fastener 230 or only two fasteners 230, for instance. Generally, the upper section 210 can be removably coupled to the lower section 220 using the fastener(s) 230.

The upper section 210 can have a connection interface 212, a platform section 214, and a pair of retaining arms 216. Notably, the upper section 210 may also have a rail support arm 218. According to one or more embodiments, the connection interface 212, the platform section 214, and the pair of retaining arms 216 can be formed of a body in the form of a bent strip or strips made of a relatively rigid material such as metal or plastic. The rail support arm 218 may also be a bent strip made of a relatively rigid material such as metal or plastic. In the case of different strips the strips can be fixedly coupled to each other via welding, for instance. According to one or more embodiments, a thickness and/or a width of the body that forms the connection interface 212, the platform section 214, and the pair of retaining arms 216 can be uniform along an entire length thereof. For instance, the body, or each strip, may be ⅛ inch thick and one inch wide (e.g., with the exception of the connection posts 223 discussed below). A height of the lower section 220 can be less than a height of the upper section 210, according to embodiments of the disclosed subject matter. In some embodiments, the platform section 214 can extend directly vertically into the connection interface 212, rather than having a small inward ledge.

The connection interface 212 can form a bottom-most portion of the upper section 210 in a case where the rail support arm 218 is considered part of the lower section 220. Generally, the connection interface 212 can be removably coupled to the lower section 220. For instance, the connection interface 212 can have an opening or aperture 213 to receive corresponding one or more (e.g., two) connection posts 223 of the lower section 220. Here, and discussed in more detail, the opening 213 can be elongate, and thus may be considered or characterized as a slot to slidably receive the connection post(s) 223. The opening 213 may be the only opening of the connection interface 212. That is, the connection interface 212 may have only one opening 213.

The platform section 214, which may be referred to as a seat or seat section, can extend from the connection interface 212. In particular, the platform section 214 can extend from opposite ends of the connection interface 212. Hence, the platform section 214 may have or define a first platform 214*a* and a second platform 214*b* opposite the first platform 214*a*, which may be referred to herein as a first platform section and a second platform section, respectively. In this regard, the first platform 214*a* and the second platform 214*b* may extend upward and outward relative to the ends of the connection interface 212. Thus, the first platform 214*a* and the second platform 214*b* may include or be in the form of a step, a first step and a second step, respectively. According to one or more embodiments, the first platform 214*a* and the second platform 214*b* can extend from opposite ends of the connection interface 212 at right angles. Hence, the first step and the second step can be right-angled steps. Optionally, the first platform 214*a* and the second platform 214*b* may be or extend parallel to the connection interface 212. The heights of the first platform 214*a* and the second platform 214*b* can be set to be at least greater than the height of the fastener(s) 230 and the connection post(s) 223 when the fastener(s) 230 is/are properly fixed to corresponding connection post(s) 223. Thus, the fastener(s) 230 and connection post(s) 223 may not extend to the height of the first platform 214*a* and the second platform 214*b*, which can prevent the fastener(s) 230 and connection post(s) 223 from interfering with the container 50 when the container 50 is seated on the platform section 214.

According to one or more embodiments, each of the first platform 214*a* and the second platform 214*b* can have one or more openings or apertures 215. A bumper 240, which can be made of rubber or plastic, can be provided in each opening 215 such that a portion of the bumper 240 extends above respective upper surfaces of the first platform 214*a* and the second platform 214*b*. Alternatively, the first platform 214*a* and the second platform 214*b* may be without any openings 215, though one or more bumpers 240 may be provided on each of the first platform 214*a* and the second platform 214*b*.

One of the retaining arms 216 may extend from each of the first platform 214*a* and the second platform 214*b*. Thus, the retaining arms 216 may be referred to herein as opposing retaining arms 216. In that the retaining arms 216 extend from the first platform 214*a* and the second platform 214*b*, the retaining arms 216 may be entirely outward of the connection interface 212. In this regard, the retaining arms 216 may extend from the first platform 214*a* and the second platform 214*b* at an angle. The angle at which the retaining arms 216 extend, according to one or more embodiments, may be ninety degrees or an obtuse angle (e.g., 95-110 degrees) relative to the first platform 214*a* and the second platform 214*b*, respectively.

The amount by which each of the retaining arms 216 extends from the platform section 214 can be greater than a height of the bottom of the bracket 200 at the connection interface 212 to the upper surface of the platform section 214. For instance, the amount by which each of the retaining arms 216 extends from the platform section 214 can be three times or more the height of the bottom of the bracket 200 at the connection interface 212 to the upper surface of the platform section 214. As an example, the amount by which each of the retaining arms 216 extends from the platform section 214 can be 4.0 inches or more. Alternatively, the length of the retaining arms 216 in the height direction can be 4.0 inches or more. Alternatively, the length of the retaining arms 216 or the amount by which each of the retaining arms 216 extends from the platform section 214 may be less than as shown in FIGS. 7-13. For instance, the arms 216 may have a length or otherwise extend from the platform section 214 at or about at a same amount as the height of the step of the first platform 214*a* and the second platform 214*b* (e.g., ¾ inch).

According to one or more embodiments, each of the retaining arms 216 can have one or more openings or apertures 217. For instance, an upper portion of each retaining arm 216 can have the aperture 217. As an example, each opening 217 can be a ¼ inch hole, for instance, a threaded hole. Each opening 217 may be a predetermined distance from respective top edges of the retaining arms 216, for instance, ⅜ inch from the top edges.

Each aperture 217 can receive a respective bumper or a retainer (e.g., a string, a chain, threaded screw, etc.) to extend from the opposing retaining arms 216 either over the container 50 provided in the upper section 210 or toward or to a corresponding sidewall of the container 50 provided in the upper section 210. Thus, optionally, each aperture 217 can be threaded to receive a threaded bumper or screw to extend inward from the retaining arm 216 to contact opposite sides of the container 50 for lateral stability of the container 50 when provided in the bracket 200.

The rail support arm 218 can extend from one end of the connection interface 212, for instance, at an interface or intersection where a bottom portion of the first platform 214*a* meets the one end portion of the connection interface 212. Optionally, the rail support arm 218 may be part of the body that forms the connection interface 212. The rail support arm 218 can include or be in the form of a side flange, which may be referred to herein as a second side flange or a second side wall. The second side flange can extend from one end of the rail support arm 218, for instance, downward (e.g., at a ninety-degree angle). A tip or end of the second side flange may be bent inward, for instance, at ninety degrees, relative to the preceding part of the second side flange. The dimensions (e.g., geometry, height, width, etc.) of the rail support arm 218 can be based on the railing 75 to which the bracket 200 is to be removably coupled. For instance, the sizing of the rail support arm 218 can be to fit rail sizes 1×4, 1×6, 2×4, or 2×6 (in inches).

According to one or more embodiments, a spacer 219 can be provided as part of the rail support arm 218. The spacer 219 can be provided at an upper inside corner of the rail support arm 218, at the top of the second side flange. The spacer 219, which can be made of a relatively rigid material such as metal, may be fixedly (e.g., welded) coupled to the rail support arm 218 and may be considered part of the rail support arm 218. According to one or more embodiments, the spacer 219 may be formed in one piece with the rail support arm 218. Discussed in more detail below, the spacer 219 can be to interface with a corresponding portion of the interface section 222, particularly when setting a clamping width of the lower section 220 to the railing 75. The spacer 219 can additionally or alternatively allow for the bracket 200 to be mounted flush or level on the railing 75 top so as to minimize or eliminate wobbling and/or loosening.

An adjustment screw 221 can be provided through a threaded hole in the second side flange (i.e., second side wall) of the rail support arm 218. The threaded body of the adjustment screw 221 may be oriented outward, whereas the head of the adjustment screw 221 can be oriented inward. The adjustment screw 221 can be rotated to tighten (or loosen) the fit of the bracket 200 to the railing 75, particularly a sidewall of the railing 75. In some respects, the adjustment screw can be to fine tune the fit of the bracket 200 to the railing 75. A nut or other locking member may be provided on an outer side of the second side flange to lock the adjustment screw 221 in place.

The lower section 220 can have a body that includes an interface section 222 and a rail support section 226. Generally, the lower section 220 can, in conjunction with the rail support arm 218, which can be fixed, vary a width of the lower section 220 (in the x-direction shown in FIG. 12 and FIG. 13, for instance). Thus, in some respects, the rail support arm 218 may be considered part of the lower section 220, even though the rail support arm 218 can be fixed to and extend from the connection interface 212 of the upper section 210. According to one or more embodiments, the body of the lower section 220 can be in the form of a bent strip made of a relatively rigid material such as metal or plastic. A thickness and/or a width of the body of the lower section 220 can be uniform along an entire length of the lower section 220. A height of the lower section 220 can be less than a height of the upper section 210, according to embodiments of the disclosed subject matter.

The lower section 220 can have a variable width (in the x-direction shown in FIG. 12 and FIG. 13, for instance), as noted above, based on sliding movement of the interface section 222 and the rail support section 226 relative to the rail support arm 218. One or more connection posts 223, for instance, two connection posts 223, can extend from the upper surface of the interface section 222. In the case of only one connection post 223, the connection post 223 can extend from the upper surface of the interface section 222 closer to an end of the interface section 222 from which the rail support section 226 extends.

Optionally, the connection post(s) 223 can be fixedly connected (e.g., welded, formed in one piece via machining or molded) to the upper surface of the interface section 222. Hence, each connection post 223 may be referred to or characterized as fixed or welded connection post. According to one or more embodiments, the connection post(s) 223 may be threaded. Hence, each connection post 223, according to one or more embodiments, may be referred to or characterized as a threaded post, screws, or fixed screws. The interface section 222 can include only one connection post 223 or only two connection posts 223, as examples.

The rail support section 226 can include or be in the form of a side flange 227, which may be referred to herein as a first side flange or a first side wall. The side flange 227 can extend from one end of the interface section 222, for instance, downward (e.g., at a ninety-degree angle). A tip or end of the side flange 227 may be bent inward, for instance, at ninety degrees, relative to the preceding part of the side flange 227. The dimensions (e.g., geometry, height, width, etc.) of the rail support section 226 can be based on the railing 75 to which the bracket 200 is to be removably coupled. For instance, the sizing of the rail support section 226 can be to fit rail sizes 1×4, 1×6, 2×4, or 2×6 (in inches).

A side of the rail support section 226 opposite the side from which the side flange 227 extends can include a slot 228. The slot 228 can be sized to receive the spacer 219, particularly when setting the clamping width of the lower section 220 to the railing 75. The interface between the slot 228 and the spacer 219 can be to ensure that the lower section 220 and the rail support arm 218 are aligned with each other when removably coupling the upper section 210 to the lower section 220.

The fastener(s) 230 can removably couple the upper section 210 to the lower section 220. In particular, the fastener(s) 230 can be respectively fastened to the connection post(s) 223 with the connection post(s) 223 extending through the opening 213 of the connection interface 212 of the upper section 210. As noted above, the opening 213 may be an elongate slot, thus, the connection post(s) 223 can be slidable (with the lower section 220) within the slot. Each of the fasteners 230, as an example, may be a nut with or without a washer (e.g., a wing nut) and may be respectively threaded onto threaded ends of the connection post 223 to removably couple the upper section 210 to the lower section 220. Each connection post 223 may be considered part of the corresponding fastener 230 according to one or more embodiments of the disclosed subject matter. Tightening the fastener(s) 230 onto the respective connection post(s) 223 can set the width of the lower section 220.

Figure 12:
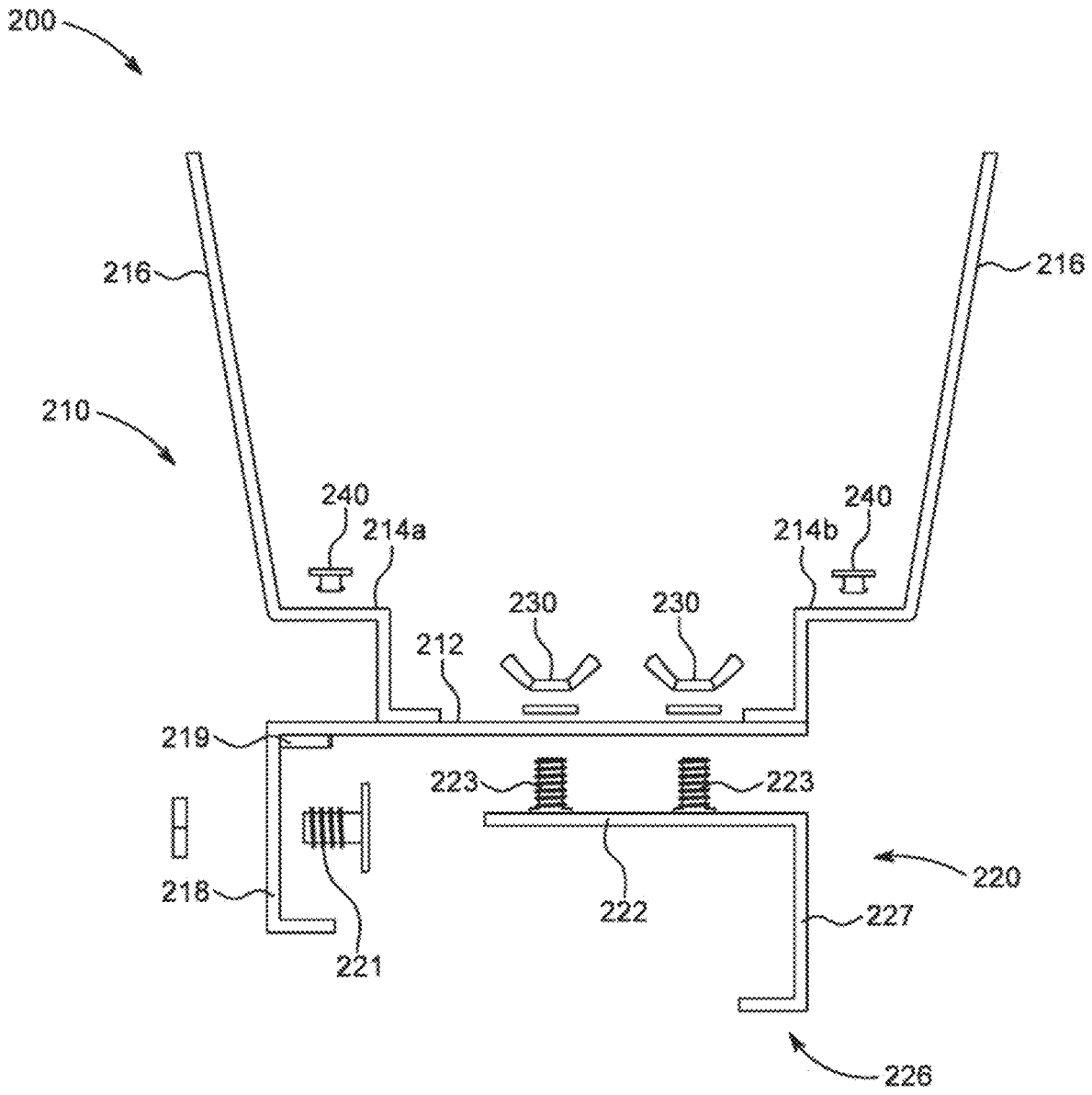
FIG. 12 is an exploded view of the bracket assembly of FIG. 7.
Figure 13:
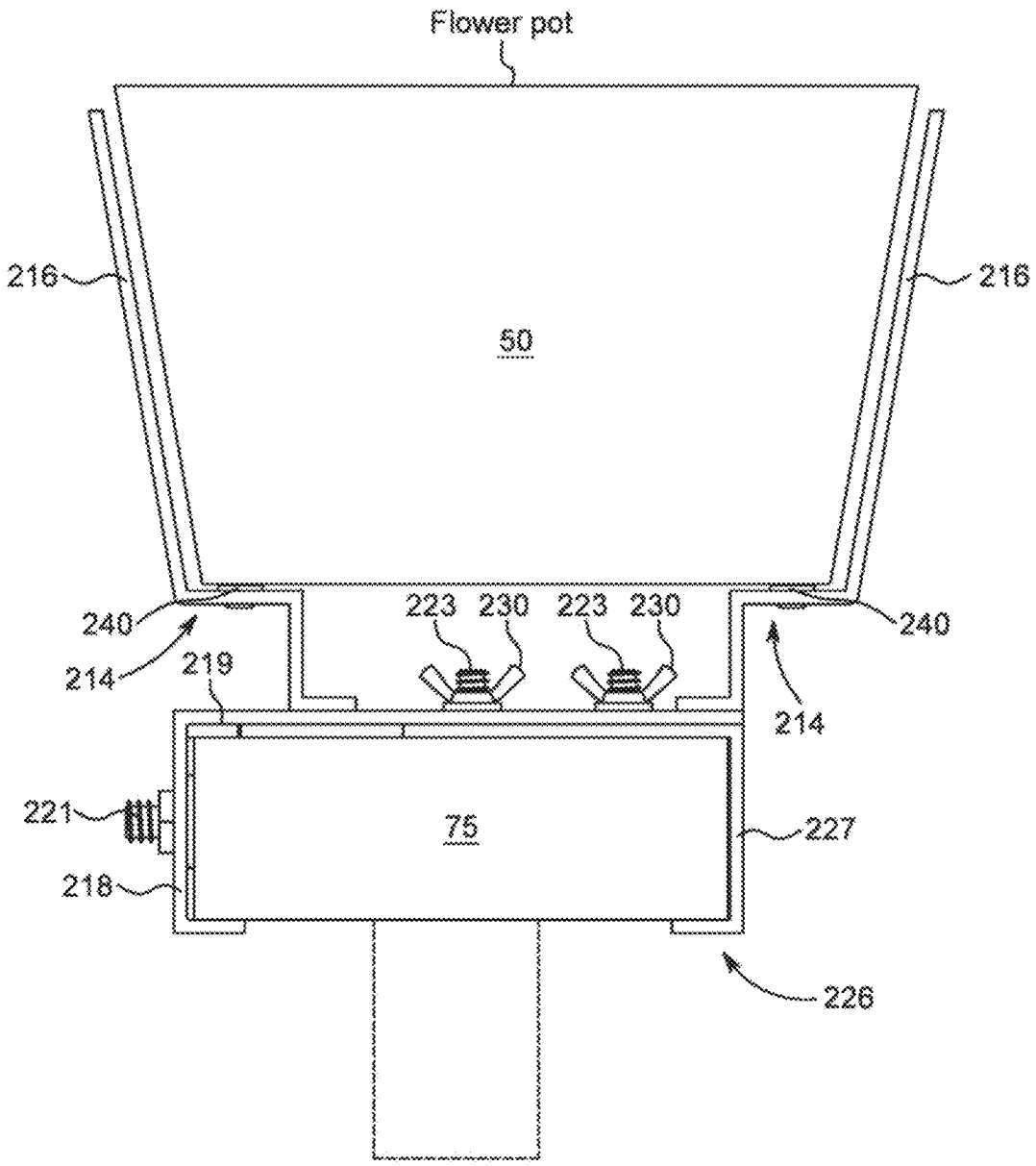
FIG. 13 is an exemplary use view of the bracket assembly of FIG. 7 removably coupled to a rail.

Turning now to FIG. 12 and FIG. 13, as shown, the upper section 210 can be removably coupled to the lower section 220 via the fastener(s) 230 fastening to the respective connection post(s) 223. Here, as noted above, the fastener(s) 230 can be fastened to respective connection post(s) 223 with the connection post(s) 223 extending through the opening 213 of the connection interface 212 of the upper section 210, which can be an elongate slot, as noted above.

As shown in FIG. 13, the upper section 210 can be removably coupled to the lower section 220 such that the bracket 200 can be removably coupled to the rail or railing 75 by the connection of the upper section 210 to the lower section 220. More specifically, the upper section 210 and the lower section 220, when removably coupled to each other (and the railing 75), may not completely surround the railing 75. Rather, a bottom portion (e.g., bottom wall or surface) of the railing 75 may be exposed when the bracket 200 is removably coupled to the railing 75. Thus, the bracket 200 may be referred to or characterized as a top-mounted or mounting bracket. In this regard, however, the connection interface 212, the platform section 214, and the retaining arms 216 of the upper section 210 may be entirely above the railing 75 when the bracket 200 is removably coupled to the railing 75. Here, the rail support arm 218 and the lower section 220 can be arranged adjacent to coupling interfaces of the railing 75 when the bracket 200 is removably coupled to the railing 75.

The fitting of the bracket 200 to the railing 75 can be adjustable. That is, the lower section 220 can be adjustable to adjust the width of a connection interface with the railing 75. In particular, with the connection post(s) 223 extending through the opening 213 and optionally loosely connected to the fastener(s) 230, the lower section 220 can be slid along the length of the opening 213 relative to the rail support arm 218. Such movement of the lower section 220 can be to removably couple the bracket 200 to the railing 75 via connection to the first side flange 227 of the lower section 220 and the rail support arm 218, particularly the second sidewall thereof. The top or upper surface of the railing 75 may contact or otherwise be adjacent to the bottom surface of the interface section 222. Once the width of the lower section 220 can be slid along the length of the opening 213 relative to the rail support arm 218 is set to contact and be held by the railing 75, the fastener(s) 230 can be tightened to the connection post(s) 223 to removably couple and hold the bracket 200 to the railing 75. The adjustment screw 221 may be adjusted to engage the railing 75 to fine tune the tightness of the fit of the bracket 200 to the railing 75.

The upper section 210 can form a receptacle to receive at least a portion of the container 50, such as a planter box or the like. In particular, as shown in FIG. 13, for instance, the body of the upper section 210 can be bent so as to form a receptacle to receive the container 50. In some respects, the upper section 210 can also retain the portion of the container 50 in the receptacle. A bottom of the container 50 can be provided on the platform section 214. That is, opposite sides of the bottom of the container 50 can rest on the first platform **214*a* and the second platform 214*b*, respectively. Optionally, as noted above, the bottom of the container 50 can rest on bumpers 240 provided at least on the upper surfaces of the first platform 214*a* and the second platform 214*b*. Opposing sides of the container 50 can be provided between the opposing retaining arms 216. When provided between the retaining arms 216, the sides of the container 50 may abut or be adjacent to the retaining arms 216. Thus, a minimum width between the retaining arms 216 can be greater than a maximum width of the container 50**.

The bracket 200 may be part of a kit to retain and hold the container 50 above the railing 75, such as shown in FIG. 12. For instance, the kit may contain or consist of at least two brackets 200 (with or without fastener(s) 230). Thus, a portion of the container 50 (e.g., first end portion) can extend through the receptacle formed by one of the brackets 200 and another portion of the container 50 (e.g., second end portion) can extend through the receptacle formed by another of the brackets 200.

Figure 14:
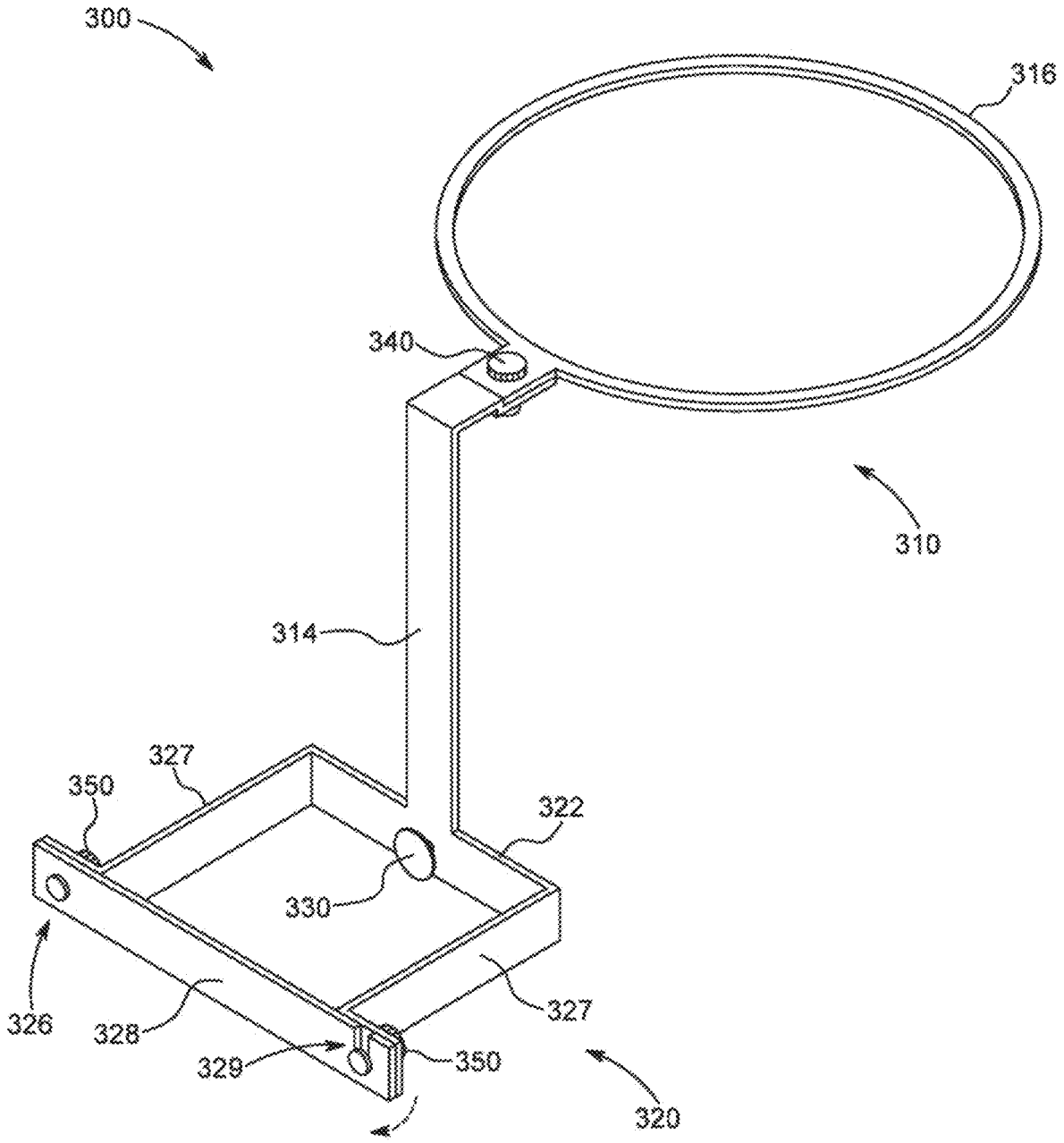
FIG. 14 is a perspective view of another bracket assembly according to one or more embodiments of the disclosed subject matter.
Figure 15:
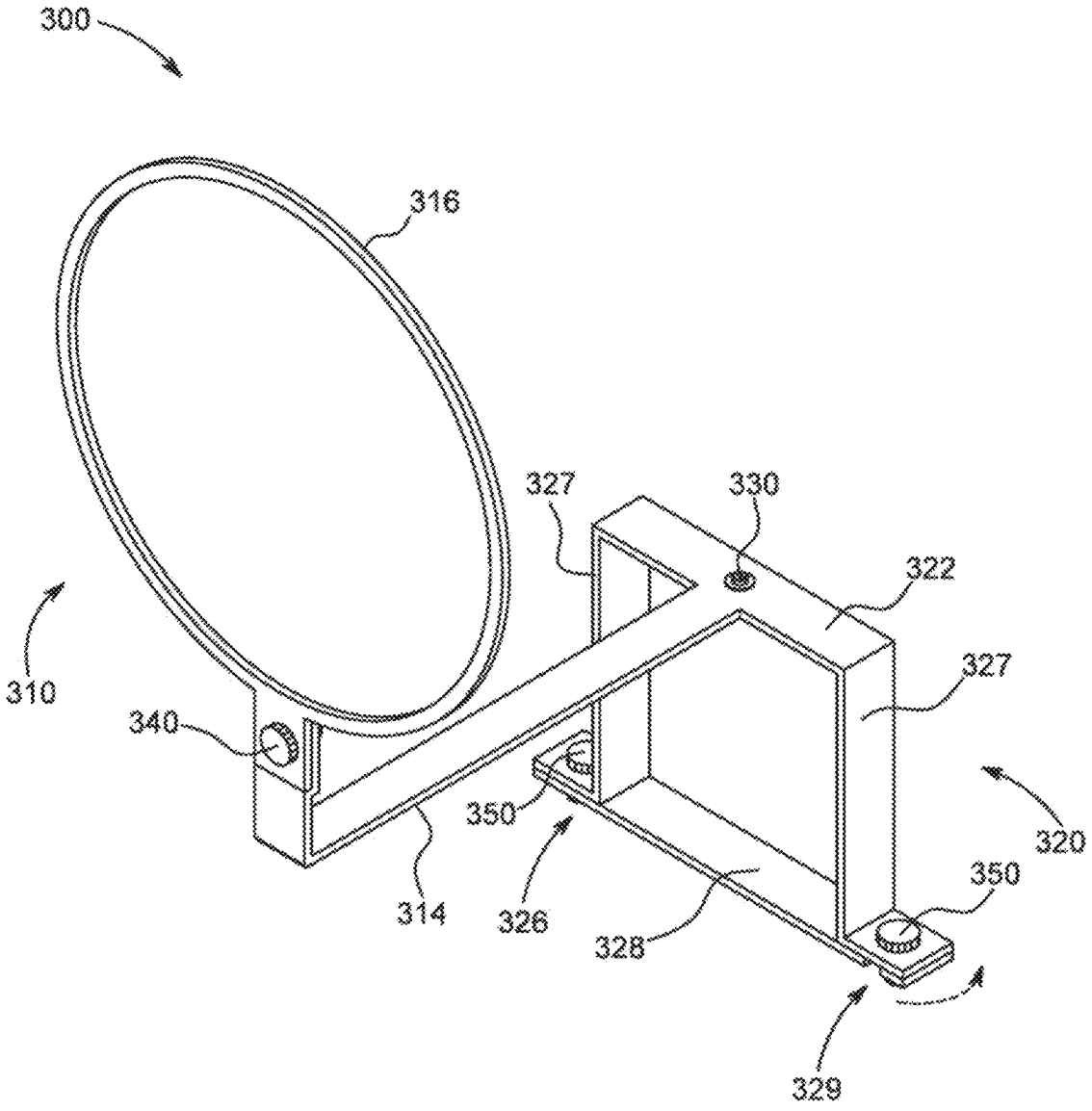
FIG. 15 is another perspective view of the bracket assembly of FIG. 14.

FIG. 14 and FIG. 15 show a bracket 300 according to one or more embodiments of the disclosed subject matter. The bracket 300 can have an upper section 310 and a lower section 320. At least part of the upper section 310 can be fixedly coupled to the lower section 320. Optionally, such fixed coupling can be via welding, for instance.

The upper section 310 can have a platform section 314 and a retaining arm 316. The platform section 314 can have a body in the form of a strip formed of a rigid material, such as metal or plastic. An upper portion of the platform section 314 may take the form of a L-shape, for instance, at a ninety degree angle, with a step portion to receive the retaining arm 316.

The retaining arm 316 can be in the form of a ring with a tab portion extending from an outer edge thereof. In some respects the retaining arm 316 may be viewed as two arms extending from opposite sides of the tab portion and connecting with each other 360 degrees opposite the tab portion. The retaining arm 316 can be formed of a rigid material, such as metal or plastic. Optionally, the ring of the retaining arm 316 can be formed of twisted wire and fixedly coupled (e.g., welded) to the tab portion. The tab portion of the retaining arm 316 can fit with the step portion of the platform section 314.

As shown in FIG. 14 and FIG. 15, the fastener 340 can removably couple the tab portion of the retaining arm 316 to the step portion of the platform section 314. A container, such as a circular plant pot, can be received in the inner volume of the retaining arm 316 and held by the retaining arm 316. Thus, according to embodiments of the disclosed subject matter, a circumferential lip or edge of the container can rest on the upper surface of the ring of the retaining arm 316.

As an example, the fastener 340 may be comprised of a connection post extending from an upper surface of the step portion of the upper portion of the platform section 314 through an opening in the tab portion of the retaining arm 316 so as to extend from and above an upper surface of the tab portion of the retaining arm 316. The connection post can be threaded. As such, a nut, such as a thumb screw nut, can be threaded onto and tightened to the connection post to removably couple the retaining arm 316 to the platform section 314, such as shown in FIG. 14 and FIG. 15. Of course, embodiments of the disclosed subject matter are not limited to the fastener 340 shown in FIG. 14 and FIG. 15 in order to removably couple the retaining arm 316 to the platform section 314.

The lower section 320 can have an interface section 322 and a rail support section 326. The interface section 322 can be fixedly coupled (e.g., via welding) to an end of the platform section 314 opposite the end adapted to be removably coupled to the retaining arm 316. Optionally, the interface section 322 may be formed in one piece with the platform section 314. According to one or more embodiments, the interface section 322 may be considered part of the rail support section 326. In any event, the rail support section 326 can include a pair of opposing side flanges 327 and an end flange 328.

A tension screw 330, which may be referred to as a grip screw or grip flange, can be provided through an opening (e.g., a threaded opening) in the interface section 322 of the lower section 320, such as shown in FIG. 14 and FIG. 15. The tension screw 330 can employ a so-called lock-fit so as to be retained without being removable. As shown in FIG. 15, the tension screw 330 can have a washer or relatively large diameter/surface at an end facing the end flange 328. Such end can be to contact the railing when the bracket 300 is provided in place around the railing. Moreover, the tension screw 330 can be adjusted to make the bracket 300 fit more tightly with the railing.

The internal volume formed by the interface section 322, the side flanges 327, and the end flange 328 forming the rail support section 226 can be dimensioned to fit rail sizes 1×4, 1×6, 2×4, or 2×6 (in inches), as examples. Fasteners 350 can be provided to removably couple the end flange 328 to the opposing side flanges 327, such as shown in FIG. 14 and FIG. 15, via respective openings (e.g., threaded openings) in the outwardly flared end portions of the side flanges 327 and corresponding end portions of the end flange 328. According to one or more embodiments, a slot or slit 329 may be provided in one end portion of the end flange 328. When the fasteners 350 are not entirely tightened (e.g., slightly loose), the end flange 328 can be rotated to swing open about the fastener 350 on the other side opposite the slot 329, such as diagrammatically shown in FIG. 14 and FIG. 15. This can allow the lower section to be fitted around the railing. The end flange 328 can then be rotated back to the position shown in FIG. 14 and the fasteners 350 tightened to removably couple the bracket 300 to the railing. Optionally, one or more spacers may be provided between the railing and the interface section 322, the side flange(s) 327, and/or the end flange 328 to provide a custom fit to the railing.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A bracket comprising:

a first bent strip;

a second bent strip;

a third bent strip having an upper surface and a lower surface opposite the upper surface, the first bent strip and the second bent strip extending from the upper surface of the third bent strip;

a fourth bent strip extending from the lower surface of the third bent strip; and at least one fastener to removably couple the bracket to a rail, wherein at least the first bent strip and the second bent strip form a receptacle, wherein the first bent strip and the second bent strip include:

a plurality of platform sections, including a first platform section and a second platform section, a first retaining arm extending from the first platform section, and a second retaining arm extending from the second platform section, wherein the third bent strip includes:

a connection interface having at least one opening, wherein at least one welded screw extends from an upper surface of the fourth bent strip to interface with the at least one opening of the connection interface and removably couple the fourth bent strip to the third bent strip, wherein the first platform section includes a first bent step and the second platform section includes a second bent step, wherein a width of the bracket is adjustable based on a movement of the fourth bent strip relative to the third bent strip, wherein the width of the bracket is settable using the at least one fastener removably coupled to the at least one welded screw, and wherein each of the first and second retaining arms extends upward from a respective one of the first and second platform sections at a ninety-degree angle or at an outward obtuse angle relative to the respective one of the first and second platform sections, such that a free end of each of the first and second retaining arms terminates facing in an upward direction.

2. The bracket according to claim 1, wherein each of the first and second retaining arms extends from the respective one of the first and second platform sections at the outward obtuse angle relative to the respective one of the first and second platform sections, and/or wherein each of the first and second platform sections extends from the upper surface of the third bent strip at a right angle.

3. The bracket according to claim 1, wherein each of the first, second, third, and fourth strips is made of metal.

4. The bracket according to claim 1, wherein the first and second retaining arms are entirely outward of the connection interface.

5. The bracket according to claim 1, further comprising:

a plurality of rubber or plastic bumpers, wherein each of the plurality of rubber or plastic bumpers is provided on an upper surface of a respective one of the first and second platform sections.

6. The bracket according to claim 1, wherein the bracket is configured to partially surround the rail in a case where the bracket is removably coupled to the rail.

7. The bracket according to claim 1, wherein the at least one welded screw consists of two welded screws, the at least one opening of the connection interface consists of a single elongate slot, and the at least one fastener consists of two fasteners, and wherein each of the two welded screws extends from the upper surface of the fourth bent strip to interface with the single elongate slot and a respective one of the two fasteners to removably couple the fourth bent strip to the third bent strip.

8. The bracket according to claim 1, wherein the third bent strip includes a first side flange that extends in a direction away from one of the first bent strip or the second bent strip, wherein the fourth bent strip includes an interface section and a second side flange that extends from one end of the interface section in a direction away from the other of the first bent strip or the second bent strip, and wherein the width of the bracket is adjustable based on a movement of the second side flange relative to the first side flange.

9. The bracket according to claim 8, wherein an adjustment screw extends through the first side flange and inward toward the second side flange, and wherein the adjustment screw is adjustable to tighten the bracket to the rail.

10. A kit for holding a box on a railing, the kit comprising:

a first bracket assembly; and a second bracket assembly, wherein each of the first bracket assembly and the second bracket assembly includes:

a first strip;

a second strip;

a third strip having an upper surface and a lower surface opposite the upper surface, the first strip and the second strip extending from the upper surface of the third strip;

a fourth strip extending from the lower surface of the third strip; and a plurality of fasteners, wherein, for each of the first bracket assembly and the second bracket assembly:

at least the first strip and the second strip form a receptacle to receive the box, the first strip and the second strip include:

a pair of platform sections, including a first platform section and a second platform section spaced apart from the first platform section, and a pair of retaining arms, including a first retaining arm extending from the first platform section and a second retaining arm extending from the second platform section, the third strip includes:

a connection interface having an elongate opening, a plurality of connection posts project from the fourth strip to extend through the elongate opening of the connection interface and to couple to the plurality of fasteners, the first platform section includes a first bent step and the second platform section includes a second bent step, the first and second platform sections extend from the connection interface to the first and second retaining arms, respectively, a width for coupling to the railing is adjustable based on a movement of the fourth strip, the width for coupling to the railing is settable using the plurality of fasteners removably coupled to the plurality of connection posts, and each of the first and second retaining arms extends straight from a respective one of the first and second platform sections to a free end of the respective retaining arm.

11. The kit according to claim 10, wherein, for each of the first bracket assembly and the second bracket assembly:

each of the first and second retaining arms extends from the respective one of the first and second platform sections at an obtuse angle, and/or each of the first and second platform sections extends from the connection interface at a right angle.

12. The kit according to claim 10, wherein, for each of the first bracket assembly and the second bracket assembly:

a height of each of the first and second retaining arms is greater than a height of the third strip, each of the first, second, third, and fourth strips is bent, and/or each of the first, second, third, and fourth strips is made of metal.

13. The kit according to claim 10, wherein, for each of the first bracket assembly and the second bracket assembly:

the first and second retaining arms are outward of the connection interface.

14. The kit according to claim 10, wherein, for each of the first bracket assembly and the second bracket assembly:

the first and second platform sections are welded to the upper surface of the third strip.

15. A system comprising:

a bracket adapted to be removably coupled to a rail, the bracket including:

a first bent strip;

a second bent strip;

a third bent strip having an upper surface and a lower surface opposite the upper surface, the first bent strip and the second bent strip extending from the upper surface of the third bent strip; and a fourth bent strip extending from the lower surface of the third bent strip; and wherein at least the first bent strip and the second bent strip form a receptacle, wherein the first and second bent strips include:

a pair of platform sections, including a first platform section and a second platform section, and a pair of retaining arms, including a first retaining arm extending from the first platform section and a second retaining arm extending from the second platform section, wherein the third bent strip includes:

a connection interface, wherein a plurality of connection screws extend from an upper surface of the fourth bent strip to interface with a plurality of fasteners, wherein the first platform section includes a first bent step and the second platform section includes a second bent step, wherein each of the first and second bent steps extends from the third bent strip to a respective one of the first and second retaining arms, wherein the first and second retaining arms are outward of the connection interface, wherein a width of the bracket for coupling to the rail is adjustable based on a movement of the fourth bent strip, wherein each of the first and second retaining arms extends straight from a respective one of the first and second platform sections to a free end of the respective retaining arm opposite the respective one of the first and second platform sections.

16. The system according to claim 15, wherein each of the first and second platform sections extends from the upper surface of the third bent strip at a right angle.

17. The system according to claim 15, further comprising another said bracket.

18. The system according to claim 15, wherein the bracket further includes a plurality of rubber or plastic bumpers each provided on an upper surface of a respective one of the first and second platform sections.

19. The system according to claim 15, wherein the width of the bracket for coupling to the rail is settable using the plurality of fasteners interfacing with the plurality of connection screws.

20. The system according to claim 15, wherein the connection interface includes an opening through which the plurality of connection screws extend to interface with the plurality of fasteners.

* * * * *